US005507482A

United States Patent [19]

Tenpaku et al.

[11] Patent Number: 5,507,482

[45] Date of Patent: Apr. 16, 1996

[54] SHEET FEEDING APPARATUS

[75] Inventors: Chitose Tenpaku, Kawasaki; Noriyoshi Ishikawa, Yokohama, both of Japan

[73] Assignee: Canon Kabushiki Kaisha, Tokyo, Japan

[21] Appl. No.: 203,602

[22] Filed: Feb. 28, 1994

Related U.S. Application Data

[63] Continuation of Ser. No. 824,186, Jan. 22, 1992, abandoned.

[30] Foreign Application Priority Data

Jan. 24, 1991 [JP] Japan ..... 3-022692
Mar. 19, 1991 [JP] Japan ..... 3-080819

[51] Int. Cl.[6] ..... B65H 9/16

[52] U.S. Cl. ..... 271/251; 271/272

[58] Field of Search ..... 271/250, 251, 271/272

[56] References Cited

U.S. PATENT DOCUMENTS

| | | | |
|---|---|---|---|
| 458,945 | 9/1891 | Crane | 271/251 |
| 2,464,173 | 3/1949 | Broadmeyer | 271/251 |
| 3,175,824 | 3/1965 | Albosta | 271/251 |
| 3,635,466 | 1/1972 | Townsend | 271/251 |
| 3,666,262 | 5/1972 | Fowler et al. . | |
| 3,929,327 | 12/1975 | Olson . | |
| 3,980,296 | 9/1976 | Craft et al. . | |
| 4,098,551 | 7/1978 | Komori et al. . | |
| 4,374,586 | 2/1983 | Lamos et al. . | |
| 4,378,737 | 4/1983 | Kirkpartick . | |
| 4,546,964 | 10/1985 | Linthout | 271/251 X |
| 4,836,527 | 6/1989 | Wong . | |
| 4,877,234 | 9/1990 | Mandel . | |
| 4,889,240 | 12/1989 | Sato | 271/251 X |
| 4,955,965 | 9/1990 | Mandel | 271/251 X |

FOREIGN PATENT DOCUMENTS

| | | | |
|---|---|---|---|
| 262562 | 4/1989 | France . | |
| 55-021383 | 2/1980 | Japan . | |
| 56-113641 | 9/1981 | Japan . | |
| 57-090344 | 6/1982 | Japan . | |
| 58-26741 | 2/1983 | Japan . | |
| 58-31844 | 2/1983 | Japan . | |
| 58-109344 | 6/1983 | Japan . | |
| 58-109345 | 6/1983 | Japan . | |
| 61-002642 | 1/1986 | Japan . | |
| 2624 | 1/1986 | Japan | 271/251 |
| 62-136454 | 6/1987 | Japan . | |
| 63-171750 | 7/1988 | Japan . | |
| 171150 | 7/1988 | Japan | 271/251 |
| 63-300043 | 12/1988 | Japan . | |
| 64-81742 | 3/1989 | Japan . | |

OTHER PUBLICATIONS

Kroeker, "Cone Roller Couple", IBM Technical Disclosure Bulletin, vol. 25, NO. 10, Mar. 1983, p. 5138.

Lamos, "Aligning Sheet Feeder", IBM Technical Disclosure Bulletin, vol. 20, No. 4, Sep. 1977, p. 1295.

*Primary Examiner*—H. Grant Skaggs

*Attorney, Agent, or Firm*—Fitzpatrick, Cella, Harper & Scinto

[57] ABSTRACT

The present invention provides a sheet feeding apparatus with a regulating guide disposed along a sheet feeding path and adapted to regulate a position of a lateral edge of a sheet, first and second rotary members for feeding the sheet along the sheet feeding path and for applying force to the sheet to urge the lateral edge of the sheet against the regulating guide, and a support device for supporting the first and second rotary members in such a manner that they can be shifted in response to reaction force corresponding to the aforementioned force and received from the sheet.

35 Claims, 7 Drawing Sheets

SHEET FEEDING APPARATUS

This application is a continuation of application Ser. No. 07,824,186 filed Jan. 22, 1992, now abandoned.

BACKGROUND OF THE INVENTION

1. Field of the Invention

The present invention relates to a sheet feeding apparatus suitable to be connected to an image forming system such as a copying machine, printer, facsimile and the like, and more particularly, it relates to an apparatus for positioning a recording sheet on which an image is to be formed in a transverse or lateral direction.

2. Related Background Art

In an image forming system such as a copying machine, printer, facsimile and the like (referred to as "copying machine and the like" hereinafter), in order to form an image on a recording sheet at a correct position, the recording sheet must be supplied to the image forming system with proper alignment of the recording sheet. The correction of the alignment of the recording sheet, i.e., the correction of tile skew-feed of the recording sheet is generally performed in a sheet supplying/feeding apparatus. In this case, the correction methods are generally grouped into two kinds depending upon which portion of the recording sheet is used as a reference.

A first correction method utilizes a sheet supplying/feeding apparatus wherein a leading end of a recording sheet is used as a reference. An example of such apparatus is shown in FIG. 9.

Such apparatus comprises sheet feed rollers 91 for feeding the recording sheet P in a direction shown by the arrow A, and a pair of upper and lower registering rollers 92*a*, 92*b* disposed at a downstream side of the sheet feed rollers 91. When the recording sheet P continues to be fed after a leading end P1 of the recording sheet P has been abutted against a nip 93 between the registering rollers 92*a*, 92*b* now stopped, a loop is formed in a portion of the recording sheet P between the sheet feed rollers 91 and the nip 93 to correct the skew-feed of the sheet. By forming the loop, the leading end P1 of the recording sheet P is urged against the nip 93, thus positioning the leading end P1 of the sheet along the nip 93 correctly. Thereafter, when the registering rollers 92*a*, 92*b* are rotated, the recording sheet P is fed in a condition that the skew-feed of the sheet is corrected by using the leading end P1 thereof as the reference. In this case, the lengths of the registering rollers 92*a*, 92*b* in a left-and-right direction (transverse direction) are so selected that a lateral width of the nip 93 becomes greater than a length of the leading end P1 of the recording sheet P.

A second method for correcting the skew-feed of the recording sheet P utilizes one lateral edge P2 of a recording sheet P as a reference, as shown in FIG. 10.

According to this second method, a reference guide 95 is disposed along a recording sheet feeding path, and, by a sheet feed roller (not shown) and skew-feed rollers 97, the recording sheet P is fed forwardly (in a direction A) and at the same time is shifted to a transverse direction (shown by the arrow B). The skew-feed rollers 97 are inclined at predetermined skew-feed angles $\alpha 1$, $\alpha$ 2, respectively, so that the recording sheet P being moved forwardly is shifted laterally by forces (referred to as "skew-feed forces" hereinafter) depending upon the skew-feed angles $\alpha 1$, $\alpha 2$, thus slidingly contacting the lateral edge P2 of the recording sheet with the reference guide 95. In this way, the skew-feed of the recording sheet is corrected by using the lateral edge P2 thereof as the reference.

FIG. 11 shows another example where a lateral edge of a recording sheet is used as a reference. In this example, a reference surface 52 is formed on a lateral surface of a frame 53, and there are disposed a tapered roller 61 having a diameter gradually decreasing toward the reference surface 52 and a cylindrical roller 62 urged against the roller 61 and driven by the rotation of the latter. By rotating the roller 61 via a gear 56, a recording sheet 51 is pinched between and fed by the rollers 61, 62. In this apparatus, since the recording sheet is subjected to a feeding force from the roller 61 and is shifted toward the reference surface 52 depending upon an amount of the taper of the roller 61, it is possible to feed the recording sheet while abutting a lateral edge of the sheet against the reference surface 52. In this apparatus, a force acting on the recording sheet 51 to shift it toward the reference surface 52 is determined by the amount of the taper of the roller 61.

However, in the above-mentioned apparatuses, when the leading end P1 of the recording sheet P is used as the reference (FIG. 9), since the registering rollers 92*a*, 92*b* having the lengths greater than the length of the leading end P1 of the recording sheet P must be arranged and a space in which the loop is formed in the recording sheet P to correct the skew-feed of the sheet must be established, the structural and spatial losses were greatly increased. Further, since the leading end P1 of the recording sheet P must be temporarily stopped at the nip 93, the time loss was also increased, thus making the speed-up of the feeding of the recording sheet difficult.

On the other hand, when the lateral edge P2 of the recording sheet is used as the reference (FIGS. 10 and 11), although the above drawbacks can be eliminated, there arose a problem that it was very difficult to properly set the skew-feed forces of the skew-feed rollers 97 acting on the recording sheet P. That is to say, if the skew-feed forces were too strong, although the lateral edge P2 of the recording sheet P reached the reference guide 95 for a short time to reduce the skew-feed correcting time, it was feared that the lateral edge P2 of the sheet was more apt to be damaged by the reference guide 95 (refer to FIG. 12). To the contrary, if the skew-feed forces were too weak, although the risk of the damage of the lateral edge P2 of the sheet was reduce, it took a long time to correct the skew-feed of the recording sheet.

Incidentally, if the lateral edge of the recording sheet is damaged, not only the worth of the recording sheet itself is diminished, but also it is more apt to cause the abnormity in the sheet feeding, such as the jamming of the sheet.

SUMMARY OF THE INVENTION

An object of the present invention is to provide a sheet feeding apparatus wherein skew-feed forces are adjustable to eliminate the structural, spatial and time losses and to prevent a lateral edge of a recording sheet from being damaged.

DETAILED DESCRIPTION OF THE PREFERRED EMBODIMENTS

The present invention will now be explained in connection with embodiments thereof with reference to the accompanying drawings.

Figure 4:
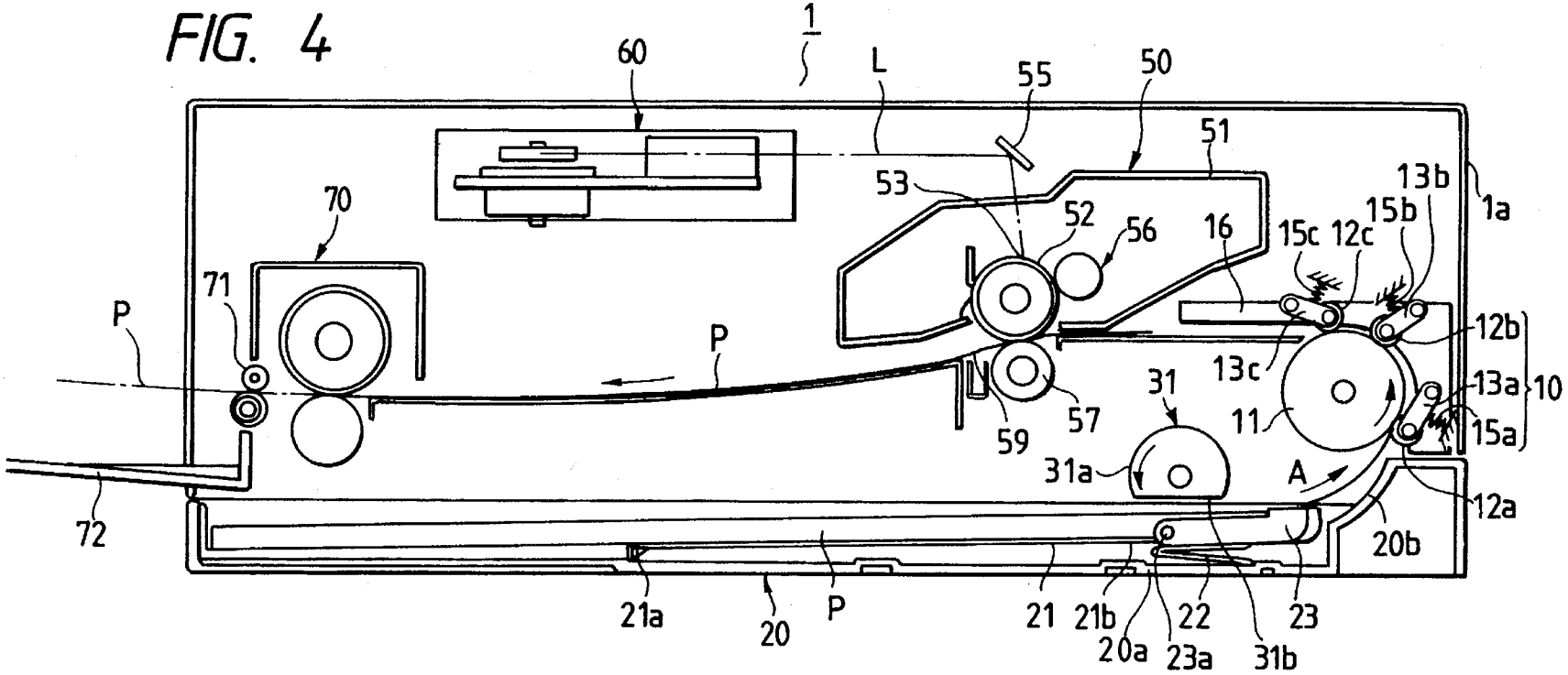
FIG. 4 is an elevational sectional view of a copying machine into which the sheet feeding apparatus according to the first embodiment is incorporated.

First of all, a laser beam copying machine 1 is shown in FIG. 4 as an example of an image forming system into which a sheet feeding apparatus 10 according to the present invention is incorporated.

In FIG. 4, a sheet supply cassette 20 containing therein a plurality of recording sheets P on each of which an image is to be formed is mounted within the copying machine 1 at a lower portion thereof. An intermediate plate 21 rockable around a rear end 21*a* thereof is disposed within the sheet supply cassette 20, and a leading end portion 21*b* of the intermediate plate 21 is biased upwardly by means of a spring 22 disposed between the intermediate plate and a bottom plate 20*a* of the sheet supply cassette 20. The recording sheets P are stacked on the upwardly biased intermediate plate 21, and separating pawls 23 contact with forward corners of an uppermost recording sheet P from above. The separating pawls 23 are rockable around pins 23*a*disposed at rear ends of the pawls so that the separating pawls ride on the forward corners of the recording sheet P by their own weights.

A sheet supply roller 31 having a cylindrical surface 31*a* and a flat surface 31*b* is disposed above the stacked recording sheets P at the leading end portions thereof. When the sheet supply roller 31 is rotated, the uppermost recording sheet P is moved by a friction force between the cylindrical surface 31*a* of the roller and the uppermost sheet and is separated from the other recording sheets by the separating pawls 23, and then is supplied forwardly (in a direction shown by the arrow A) while being guided by a guide surface 20*b* formed on a front end portion of the sheet supply cassette 20, to reach the sheet feeding apparatus 10. The sheet feeding apparatus 10 comprises a sheet feed roller 11, and a plurality of skew-feed rollers 12*a*, 12*b*, 12*c* urged against the sheet feed roller 11, so that the recording sheet P supplied by the sheet supply roller 31 is pinched between and fed by the sheet feed roller and the skew-feed rollers. The skew-feed rollers 12*a*, 12*b*, 12*c* are rotatably mounted on free ends of arms 13*a*, 13*b*, 13*c*, respectively, which arms are pivotally supported at their base ends and are attached, at their intermediate portions, to a body frame 1*a* of the machine via springs 15*a*, 15*b*, 15*c*, respectively. Further, a guide plate 16 for regulating the position of the recording sheet P in an up-and-down direction is secured to the body frame 1*a* so that the recording sheet P is guided between the sheet feed roller 11 and the guide plate 16 toward an image forming portion 50.

Incidentally, the sheet feeding apparatus 10 having the sheet feed roller 11 and the skew-feed rollers 12*a*, 12*b*, 12*c* as main components will be described in more detail later.

The image forming portion 50 is mounted inside case 1*a* and includes a photosensitive drum 52 disposed within a process cartridge 51. During the rotation of the drum, the photosensitive drum 52 is uniformly charged with predetermined positive or negative potential by means of a primary charger (not shown), and then is exposed at an exposure portion 53 by a scanning laser beam L reflected off mirror 55 and emitted from a laser scanner 60, so that intended image information is scanned and written on the photosensitive drum, with the result that electrostatic Latent images corresponding to the scanned image information are sequentially formed on the surface of the photosensitive drum 52. The photosensitive drum 52 on which the latent images were formed thereon is then developed by a developing device 56 with an image visualizing agent (toner) to visualize the latent images as toner images.

Then, when the toner images pass through a transfer roller 57, they are sequentially transferred onto the recording sheet P fed between the transfer roller 57 and the photosensitive drum 52 one by one from the sheet feeding apparatus 10. The transferring of the toner image from the photosensitive dream 52 to the recording sheet P is effected by charging the back surface of the recording sheet with the charging polarity opposite to that of the toner image by means of the transfer roller 57. Then, the charge on the recording sheet is removed from the sheet by means of a separating and charge removing probe 59 disposed at a downstream side of the transfer roller 57 and charged with the charging polarity opposite to that of the transfer roller 57, with the result that the recording sheet is separated from the photosensitive drum 52.

Thereafter, non-fixed toner images are permanently fixed to the recording sheet by a fixing device 70. Then, the recording sheet P on which the images were fixed is ejected onto an ejection tray 72 by means of a pair of ejector rollers 71.

On the other hand, after the toner image have been transferred to the recording sheet, the residual toner remaining on the photosensitive drum 52 is removed from the drum by means of a cleaning device (not shown) for preparation for the next image formation.

Figure 1:
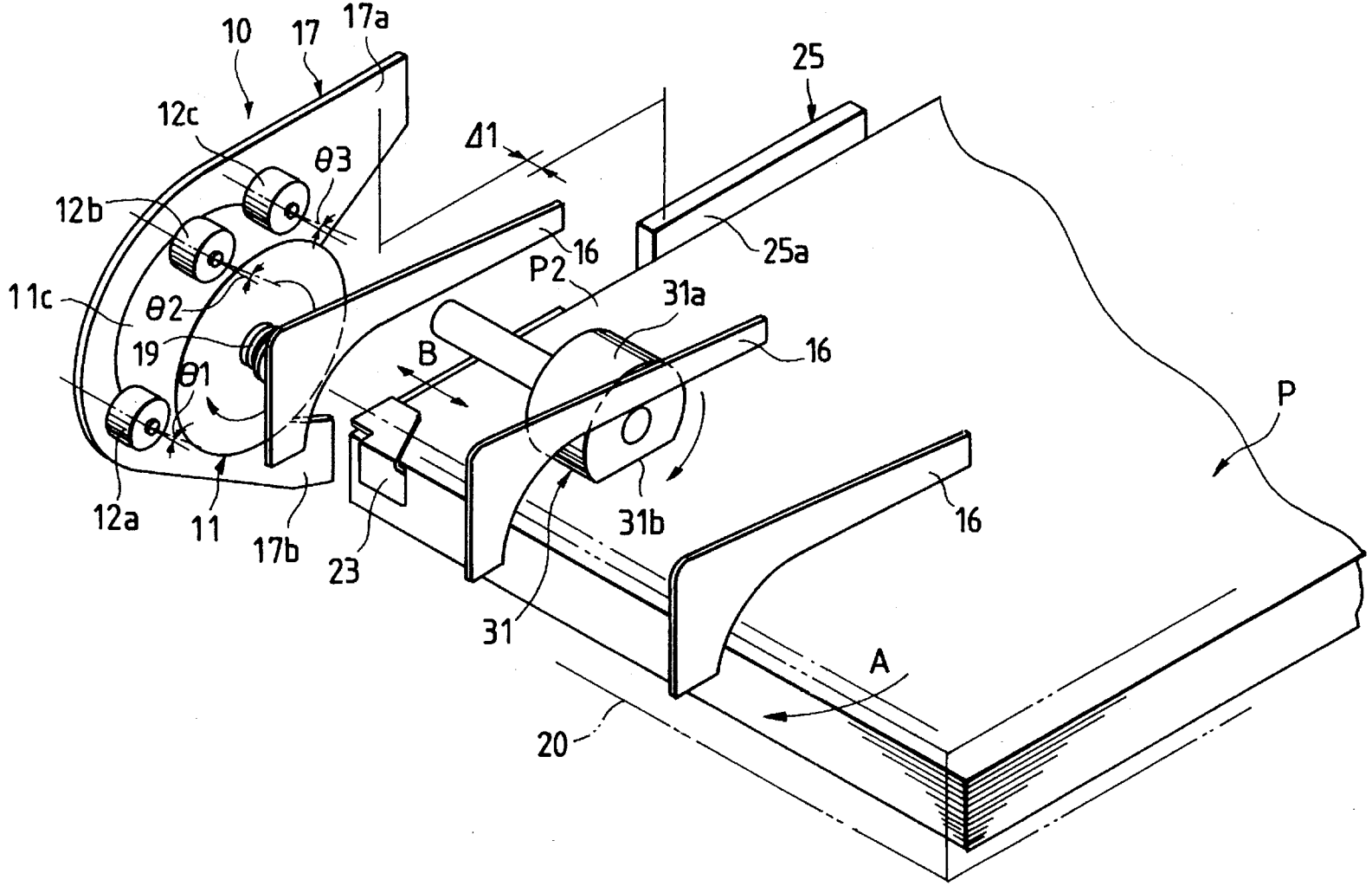
FIG. 1 is a perspective view showing the construction of a sheet feeding apparatus according to a first embodiment of the present invention.
Figure 2:
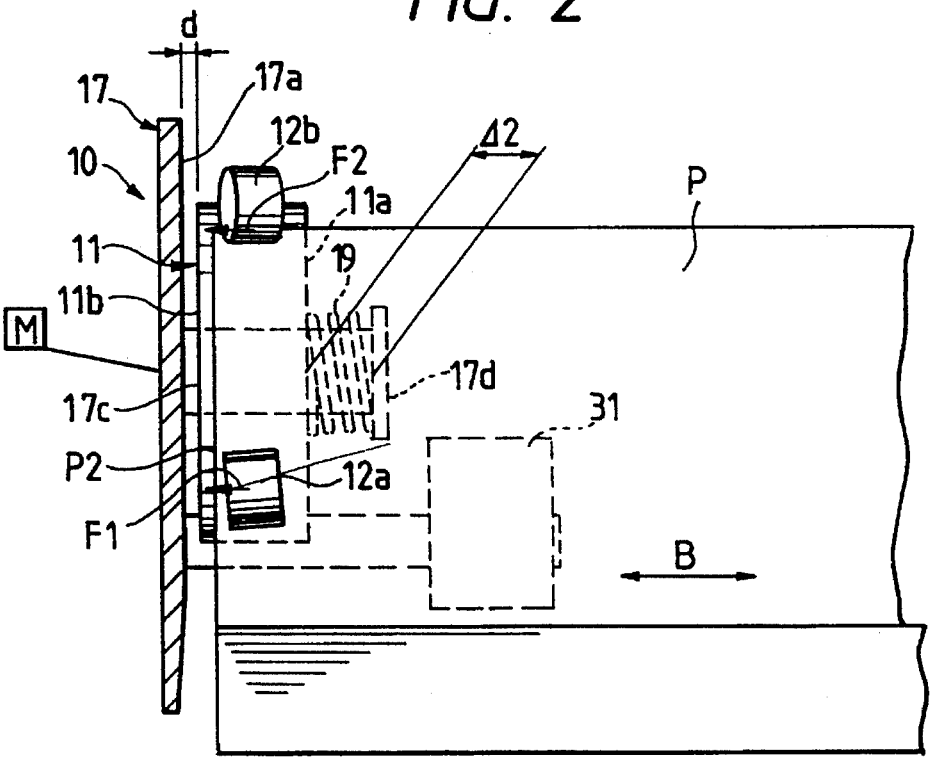
FIGS. 2 and 3 are plan views of the sheet feeding apparatus for explaining an operation thereof.

Next, the sheet feeding apparatus 10 according to the present invention will be explained with reference to FIGS. 1 and 2.

The sheet feeding apparatus 10 comprises a reference guide 17 and a compression spring 19 acting as a biasing means, as well as the aforementioned sheet feed roller 11 and skew-feed rollers 12*a*, 12*b*, 12*c*. A smooth guide surface 17*a* is formed on an inner side of the reference guide 17. The guide surface 17*a* serves to regulate a position of one lateral edge P2 of the recording sheet P in a transverse direction (shown by the arrow B), thus positioning the whole recording sheet P in the transverse direction, and to correct the skew-feed of the recording sheet P. The guide surface 17*a* is so disposed that the position thereof in the transverse direction B is situated slightly outward of the lateral edges P2 of the recording sheets P housed in the sheet supply cassette 20. That is to say, a width regulating plate 25 is arranged in the sheet supply cassette 20, and a width guide surface 25*a* is formed on an inner side of the width regulating plate to regulate one lateral edges P2 of the recording sheet P housed in the sheet supply cassette 20. A distance Δ1 between the width guide surface 25*a* and the guide surface 17*a* of the reference guide 17 is selected to be as small as possible. In this embodiment, the distance a 1 is selected to have a value of 1.5 mm. An introduction portion 17*b* of the reference guide 17 disposed near the separating pawl 23 is flared toward the separating pawl 23 so that the forward corner of the recording sheet P is not caught by the reference guide 17 when the sheet is supplied.

An attachment shaft 17*c* (FIG. 2) provided at its free end with a large diameter stopper portion 17*d* extends through a central portion of the guide surface 17*a* of the reference guide 17, which attachment shaft has a D-shaped or semicircular cross-section. The sheet feed roller 11 is non-rotatably mounted on the attachment shaft 17*c* for axial movement in a direction (shown by the arrow B). A compression spring 19 is disposed between an inner surface 11*a* of the sheet feed roller 11 and the stopper portion 17*d* of the attachment shaft 17*c*, so that, when the spring 19 is in a free condition, a proper clearance d is established between an outer surface 11*b* of the sheet feed roller 11 and the guide surface 17*a* of the reference guide 17. Thus, when the sheet feed roller 11 is subjected to an inwardly directed lateral force, i.e., a force acting to separate the sheet feed roller 11 from the reference guide 17, the compression spring 19 is compressed, with the result that the sheet feed roller 11 is biased toward the reference guide 17 by the compressed spring 19. The compression spring 19 and a distance Δ2 between the inner surface 11*a* of the sheet feed roller 11 and the stopper portion 17*d* are so selected that a shifting amount of the sheet feed roller 11 with respect to the reference guide 17 is greater than 0.5 mm but smaller than 10 mm. Incidentally, the reference symbol M denotes a motor for drivingly rotating the attachment shaft 17*c*.

The above-mentioned skew-feed rollers 12*a*, 12*b*, 12*c* are urged against an outer peripheral surface 11*c* of the sheet feed roller 11 via the above-mentioned arms 13*a*, 13*b*, 13*c* and springs 15*a*, 15*b*, 15*c*. Shafts of the skew-feed rollers 12*a*, 12*b*, 12*c* are slightly inclined at skew-feed angles θ1, θ2, θ3, respectively, with respect to the transverse direction (axial direction of the sheet feed roller 11) so that the recording sheet P is shifted laterally toward the reference guide 17 by skew-feed forces depending upon such skew-feed angles.

Skew-feed angles θ1, θ2, θ3 are obtained by measuring them on cylindrical peripheral surfaces passing through the centers of the skew-feed rollers 12*a*, 12*b*, 12*c* and having centerlines coincided with the centerline of the sheet feed roller 11. In the illustrated embodiment, such skew-feed angles are selected, for example, so that 81 becomes 0.5 degree, θ2 becomes 4 degrees, and θ3 becomes 4 degrees. Further, the urging forces of the skew-feed rollers 12*a*, 12*b*, 12*c* against the sheet feed roller 11 are about 400 grams weight in total, the skew-feed forces for shifting the recording sheet P in the transverse direction by the skew-feed rollers 12*a*, 12*b*, 12*c* are about 150 grams weight, and a spring force of the compression spring 19 is about 70 grams weight at the maximum.

Next, an operation of the sheet feeding apparatus 10 will be explained with reference to FIGS. 2 and 3.

When the leading end of the recording sheet P separated and supplied from the sheet supply cassette 20 by the sheet supply roller 31 passes through a nip between the sheet feed roller 11 driven by the motor M and the skew-feed roller 12*a*, a skew-feed force F1 acts on the recording sheet P. Even when the leading end of the recording sheet reaches the skew-feed roller 12*b*, the lateral edge P1 of the recording sheet P does not contact the reference guide 17 and the sheet feed roller 11 remains at a predetermined position as shown in FIG. 2. At this point, the skew-feed forces F1, F2 by which the skew-feed rollers 12*a*, 12*b* tend to shift the recording sheet P toward the reference guide 17 are applied to the recording sheet P.

Figure 3:
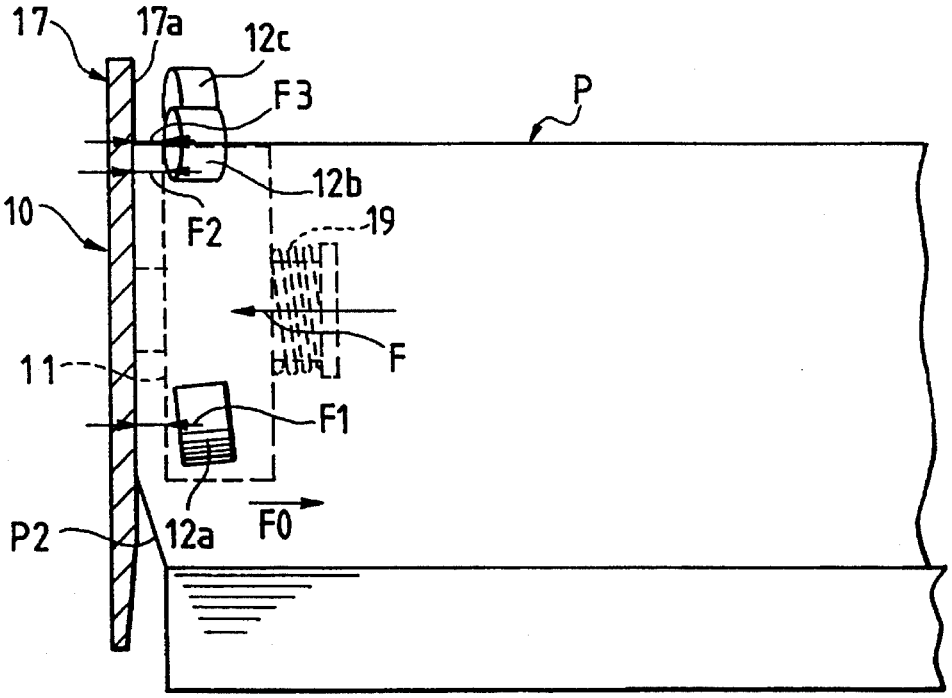

Thereafter, as shown in FIG. 3, when the leading end of the recording sheet P reaches the skew-feed roller 12*c*, the recording sheet P is subjected to a skew-feed force F3 of the skew-feed roller 12*c*, and, before or after this, the lateral edge P1 of the recording sheet P is abutted against the guide surface 17*a* of the reference guide 17. At that time, the recording sheet P is subjected to a reaction force F0 corresponding to the total skew-feed force (F1+F2+F3) from the reference guide 17, with the result that the sheet feed roller 11 is subjected to a force having substantially the same direction and magnitude as that of the reaction force F0 from the recording sheet P.

The total skew-feed force is selected to have a value of about 150 grams weight as mentioned above, and, when the total skew-feed force acts on the sheet feed roller 11, since the total skew-feed force overcomes the spring force (about 70 grams weight) of the compression spring 19, the spring is compressed, thus starting to separate the sheet feed roller 11 from the reference guide 17. In other words, when the sheet feed roller 11 starts to be separated from the reference guide 17, a force of about 70 grams weight is applied to the recording sheet P by the compression spring 19, with the result that the lateral edge P1 of the recording sheet is urged against the reference guide 17 with a force of about 70 grams weight.

That is to say, when the recording sheet P does not contact with the reference guide 17, the skew-feed forces F1, F2, F3 of the skew-feed rollers 12*a*, 12*b*, 12*c* act on the recording sheet P adequately, thus urging the recording sheet P against the reference guide 17 quickly, and, when the recording sheet P is once contacted with the reference guide 17, the recording sheet P is stably urged against the reference guide 17 with the accurate, stable and constant force F by means of the compression spring 19. Accordingly, the recording sheet P is shifted for a short time by the greater skew-feed forces until the recording sheet is abutted against the reference guide 17; and, after abutted, the recording sheet P is urged against the reference guide with the force which is smaller than the skew-feed forces and which has the good following ability via the compression spring 19, thus preventing the lateral edge P1 of the recording sheet from being damaged.

Incidentally, after the recording sheet P contacts reference guide 17, the sheet feed roller 11 is shifted laterally until the recording sheet leaves the sheet feed roller 11. In the illustrated embodiment, it was found that the shifting amount of about 3 mm was sufficient to permit such lateral shifting of the sheet feed roller.

Figure 5:
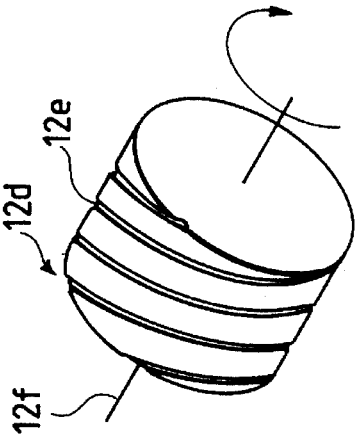
FIG. 5 is a perspective view of a skew-feed roller as an alteration.

In place of the above-mentioned skew-feed roller for applying the skew-feed force to the recording sheet P, for example, a skew-feed roller as shown in FIG. 5 may be used. As shown, such skew-feed roller is provided at its peripheral surface 12*d* with a spiral groove 12*e*. With this arrangement, even when an axis 12*f* of the skew-feed roller is not inclined, i.e., even when the axis of the skew-feed roller is disposed in parallel with the axis of the sheet feed roller 11, the skew-feed roller can apply the skew-feed force to the recording sheet P. When such skew-feed rollers are used in place of the above-mentioned skew-feed rollers 12*a*, 12*b*, 12*c* requiring the skew-feed angles θ1, θ2, θ3, the trouble that the skew-feed angles must be properly set as in the aforementioned embodiment can be eliminated, and the construction can be more simplified.

Incidentally, it should be noted that the number of the skew-feed rollers is not limited to three, but any number of skew-feed rollers may be used. Further, as the biasing means, in place of the compression spring 19, a leaf spring or a cylinder/plunger assembly may be used, for example. That is to say, any biasing means may be used so long as it can effectively bias the sheet feed roller 11. Further, in the illustrated embodiment, while an example that the recording sheets P are separated by the separating pawls was explained, the recording sheets may be separated and fed by other sheet supply means other than the separating pawls.

In the illustrated embodiment, while an example that the sheet feed roller 11 is shiftably mounted and is biased by the compression spring 19 was explained, the skew-feed rollers may be shiftable and be spring biased, or both of the sheet fed roller and the skew-feed rollers may be shiftable and be spring biased.

Figure 7:
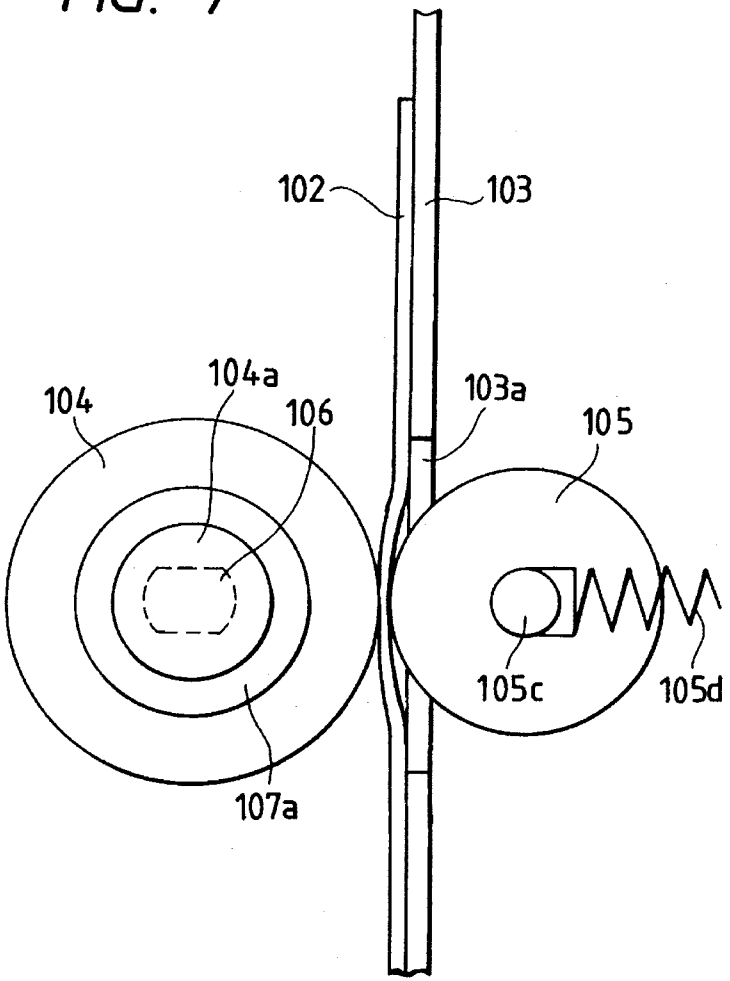
FIG. 7 is a sectional side view of a portion of the apparatus of FIG. 6.
Figure 6:
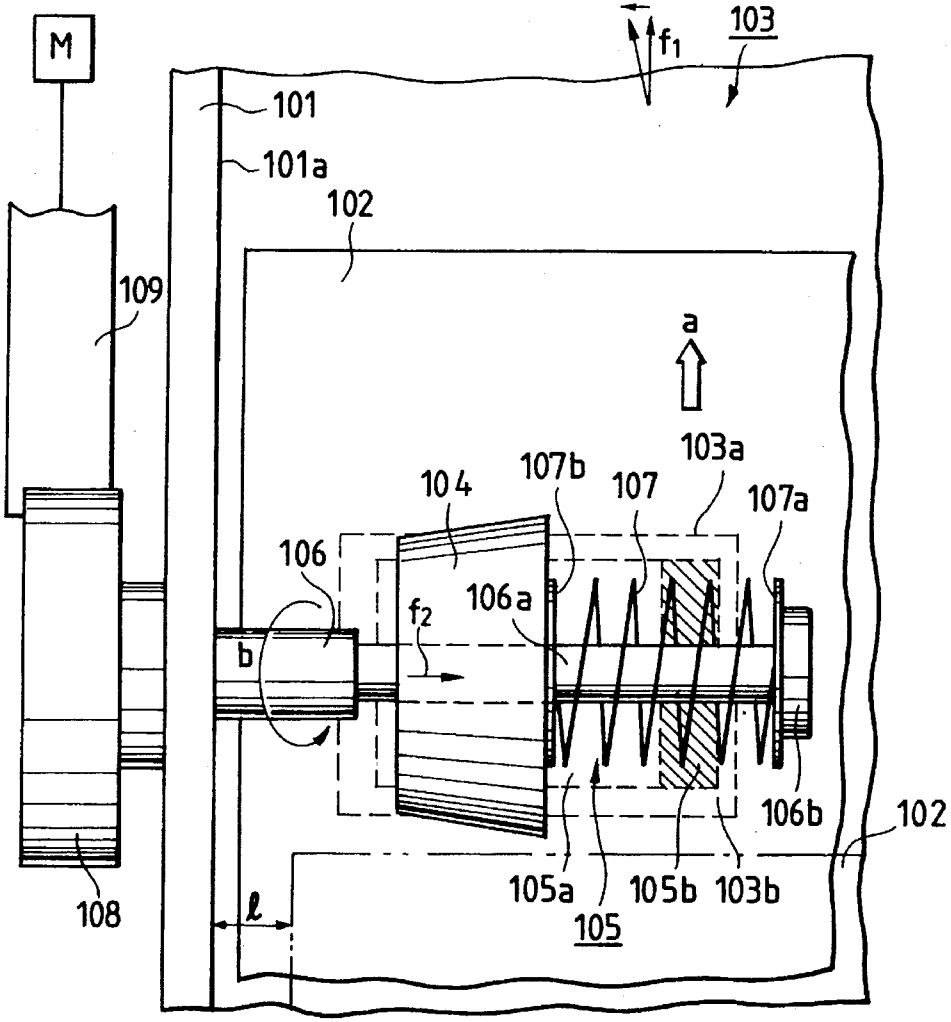
FIG. 6 is a plan view of a sheet feeding apparatus according to a second embodiment of the present invention.

FIG. 6 is a plan view of a sheet feeding apparatus according to a second embodiment of the present invention, and FIG. 7 is a side view of the apparatus.

In FIGS. 6 and 7, a body frame 101 of the sheet feeding apparatus is disposed along a sheet feeding direction shown by the arrow a for a recording sheet 102. A reference surface 101*a* for regulating the sheet feeding direction for the recording sheet 102 is formed on an inner side surface of the body frame 101, and a guide 103 acting as a sheet feeding surface for the recording sheet 102 is disposed at a side (right side in FIG. 6) of the reference surface 101*a*.

An opening 103*a* is formed in the guide 103 at a predetermined position. A tapered sheet feed roller (rotary member) 104 is disposed above the opening 103*a* at a fixed position, and a driven roller 105 urged against the sheet feed roller 104 is disposed within the opening 103*a*. The sheet feed roller 104 is attached to a shaft 106 rotatably supported by the frame 101 and rotated by a driving force from a driving source (not shown).

When the recording sheet 102 is pinched between and fed by the sheet feed roller 104 and the driven roller 105, the sheet feed roller 104 applies a feeding force to the recording sheet 102 to shift the latter toward the direction a and toward the reference surface 101*a*. To this end, the sheet feed roller 104 has a tapered body having predetermined length and tapered angle. The tapered body of the sheet feed roller 104 attached to the shaft 106 has a diameter gradually decreasing toward the reference surface 101*a*. The driven roller 105 cooperates with the sheet feed roller 104 to feed the recording sheet 102 in the direction a. To this end, the driven roller 105 is mounted on a shaft 105*a* disposed below the guide 103 and is urged against the sheet feed roller 104 by a biasing force of a spring 105*d*. The driven roller 105 has a length longer than that of the sheet feed roller 104 and substantially equal to a length of two-flat plane portion 106*a* of the shaft 106 which will be described later. Further, the driven roller 105 has a parallel portion 105*a* of a predetermined length disposed at an end of the roller nearer to the reference surface 101*a*, and a smaller diameter portion 105*b* disposed near an end of the roller remote from the reference surface 101*a*. Thus, it is possible to apply different feeding forces to the recording sheet 102 when the parallel portion 105*a* of the driven roller 105 is urged against the sheet feed roller 104 and when the smaller diameter portion 105*b* is urged against the sheet feed roller.

As mentioned above, the shaft 106 has the two-flat plane portion 106*a* having a predetermined length, and a head 106*b* is formed on the end of the two-flat plane portion 106*a*. The sheet feed roller 104 is slidably mounted on the two-flat plane portion 106*a* of the shaft 106 by inserting a hole 104*a* of the sheet feed roller having the same cross-section as that of the two-flat plane portion 106*a* onto the latter. A spring 107 is arranged between the head 106*b* and the sheet feed roller 104 to bias the latter toward the reference surface 101*a*. The spring constant of the spring 107 is so set as to have a relatively small value. The reference numerals 107*a*, 107*b* denote rings acting as washers for the spring 107. A gear 108 is secured to the other end of the shaft 106, which gear is meshed with a gear 109 constituting a part of a gear train arranged on the frame 101. By transmitting a driving force from a drive source M to the gear 108, the sheet feed roller 104 is rotated in a direction shown by the arrow b.

Next, a sheet feeding operation effected by the sheet feeding apparatus having the above-mentioned arrangement will be explained.

First of all, it is assumed that the recording sheet 102 is supplied from a sheet supply means (not shown) in a condition that the lateral edge of the sheet is spaced apart from the reference surface 101*a* by a distance l, for example. When the sheet 102 is pinched between the sheet feed roller 104 rotating in the direction b and the driven roller 105 urged against the sheet fed roller 104, in accordance with a friction force between the sheet feed roller 104 and the sheet 102 and the tapered angle of the sheet feed roller, the sheet 102 is subjected to a force f1 directing toward the sheet feeding direction a and a force f2 directing toward the reference surface 101*a*, with the result that the sheet 102 is shifted toward the sheet feeding direction a and toward the reference surface 101*a*. In this case, a force corresponding to the force f2 acts on the spring 107 to flex the latter, so that the total force comprised of the spring force and a friction force between an inner peripheral surface of the sheet feed roller 104 and an outer peripheral surface of the shaft 106 is balanced with the force f2.

When the sheet 102 is shifted toward the reference surface 101*a* by the distance l to be abutted against the reference surface, the sheet 102 is no longer shifted toward the reference surface 101*a*. Consequently, the sheet feed roller 104 is subjected to a force f2' which is proportional to the product of a friction of coefficient between the roller 104 and the sheet 102 and the urging force of the driven roller 105. Now, a relation f2'>f2 is established.

Accordingly, when the force acting on the sheet feed roller 104 is increased, the spring 197 is compressed depending upon this force, thus shifting the sheet feed roller 104 along the two-flat plane portion 106*a* of the shaft 106 in a direction that the roller is separated from the reference surface 101*a* (toward the head 106*b*). That is to say, the spring constant of the spring 107 is selected so as to be smaller than a backling force of the sheet 102, in consideration of the friction force between the inner peripheral surface of the sheet feed roller. 104 and the outer peripheral surface of the shaft 106.

A shifting amount of the sheet feed roller 104 varies in accordance with the length of the sheet 102. That is to say, the longer the sheet 102 the greater the shifting amount of the sheet feed roller. When the sheet 102, to be fed is long, the sheet feed roller 104 is shifted toward the head 106*b* in accordance with the feeding length of the sheet 102. When the sheet feed roller 104 reaches the smaller diameter portion 105*b* of the driven roller 105, the urging force of the driven roller 105 against the sheet feed roller 104 becomes weaker. Consequently, the feeding force applied to the sheet 102 also becomes weaker, thus weakening the force f2' acting on the sheet feed roller 104. Thus, the flexing amount of the spring 107 becomes smaller than that when the sheet feed roller 104 is abutted against the parallel portion 105*a* of the driven roller 105. As a result, the spring 107 is not urged toward the head 106*b* excessively, and thus, if the sheet is long, it is not urged against the reference surface 101*a* with the excessive force, thereby preventing the damage of the spring 107.

In this way, it is possible to feed a recording sheet while abutting it against the reference surface regardless of the kind and/or material of the sheets without damaging the lateral edge of the sheet and the sheet feeding apparatus. Further, since there is no slip between the recording sheet being fed and the sheet feed roller, it is possible to lengthen the service life of the sheet feed roller. In addition, the dimensional accuracy of each of the constructural elements and/or the accuracy in attachment or positioning of these elements can be releaved.

Figure 8:
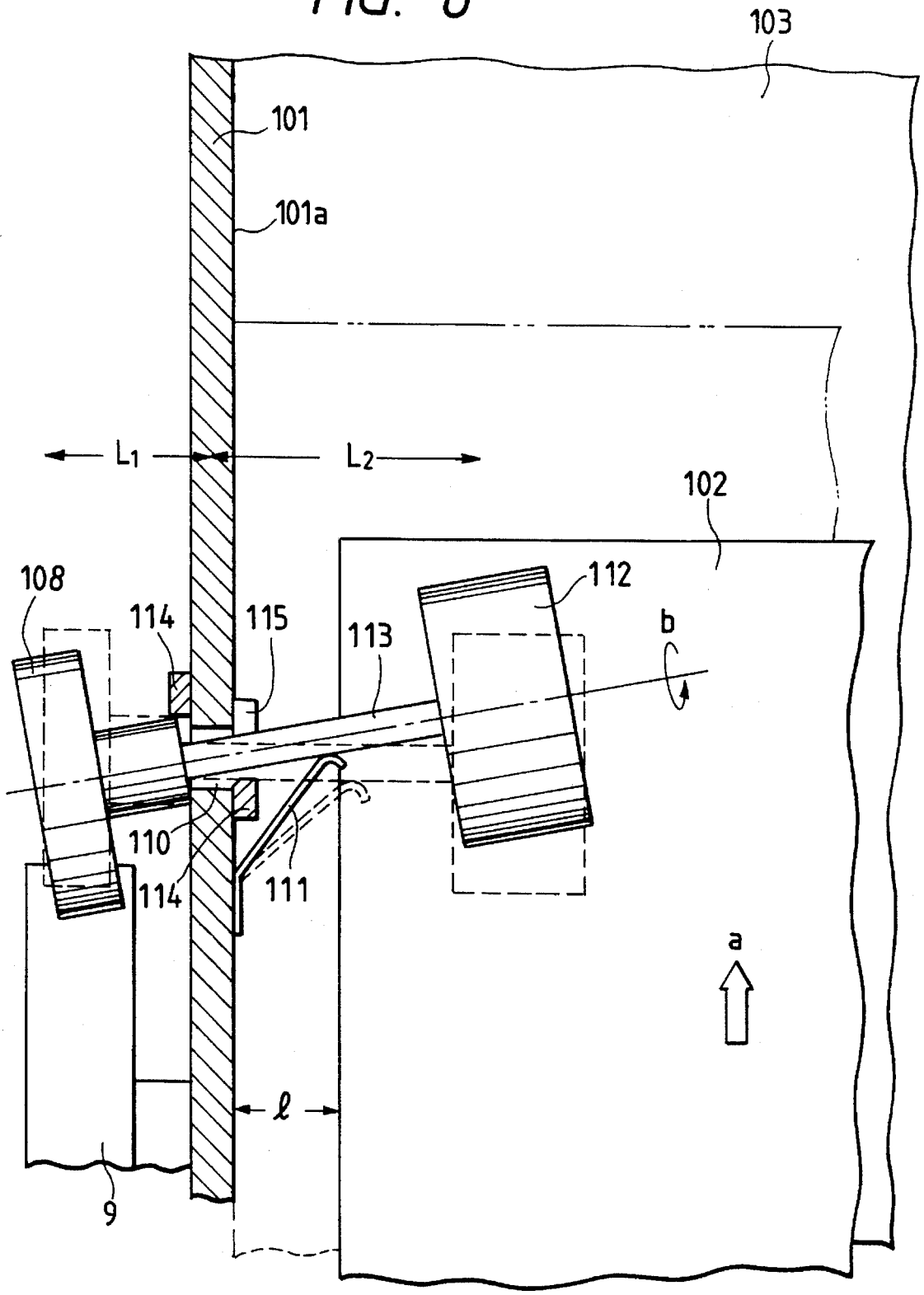
FIG. 8 is a plan view of a sheet feeding apparatus according to a third embodiment of the present invention.
Figure 9:
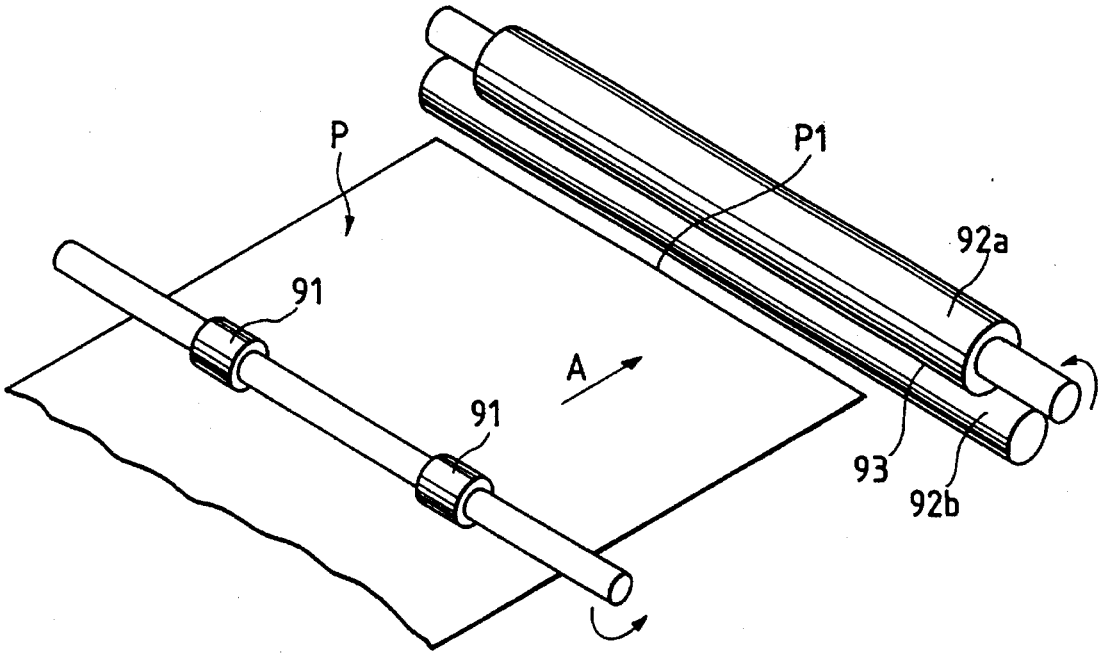
FIG. 9 PRIOR ART
FIG. 9 is a schematic perspective view of a conventional sheet feeding apparatus.
Figure 10:
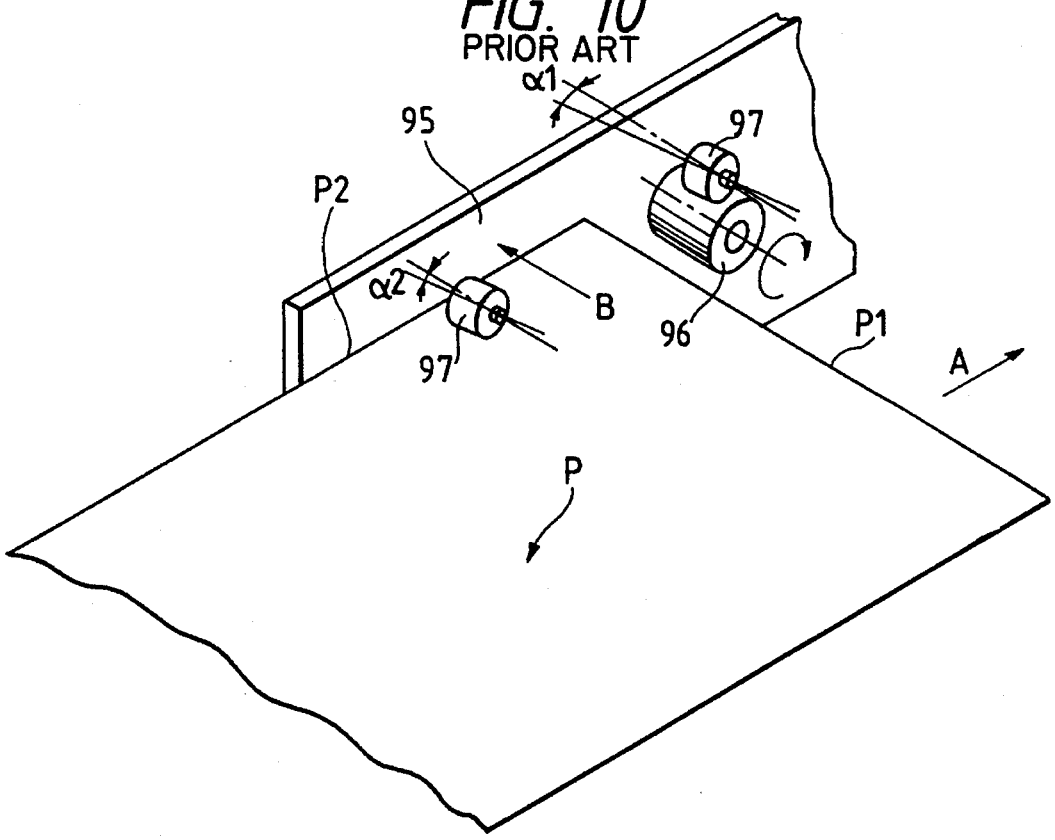
FIG. 10 PRIOR ART
FIG. 10 is a schematic perspective view of another conventional sheet feeding apparatus.
Figure 11:
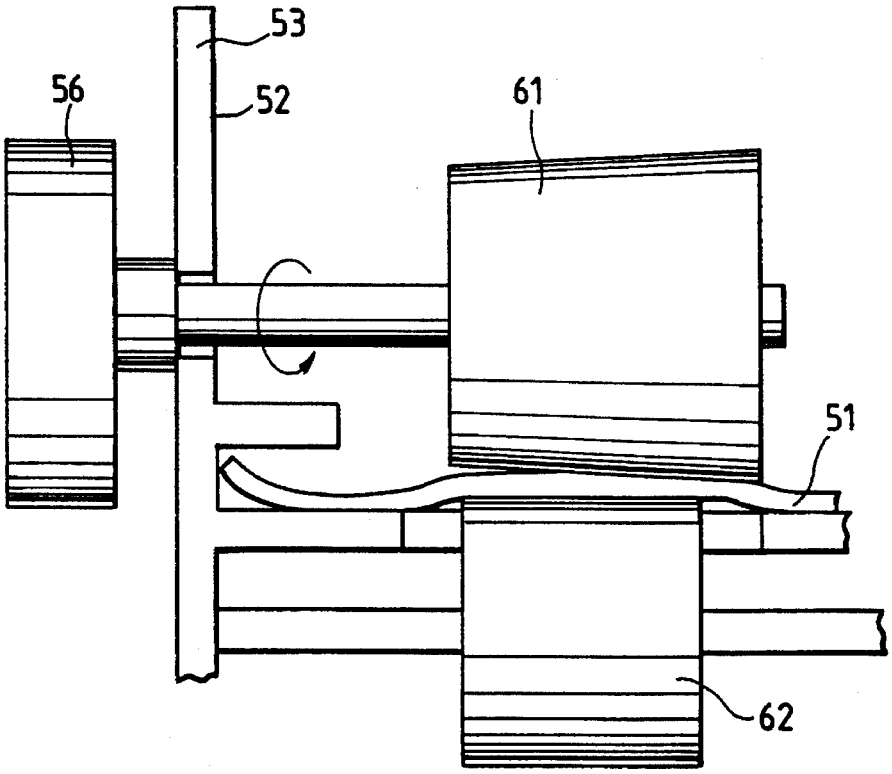
FIG. 11 PRIOR ART
FIG. 11 is an elevational view of a further conventional sheet feeding apparatus.
Figure 12:
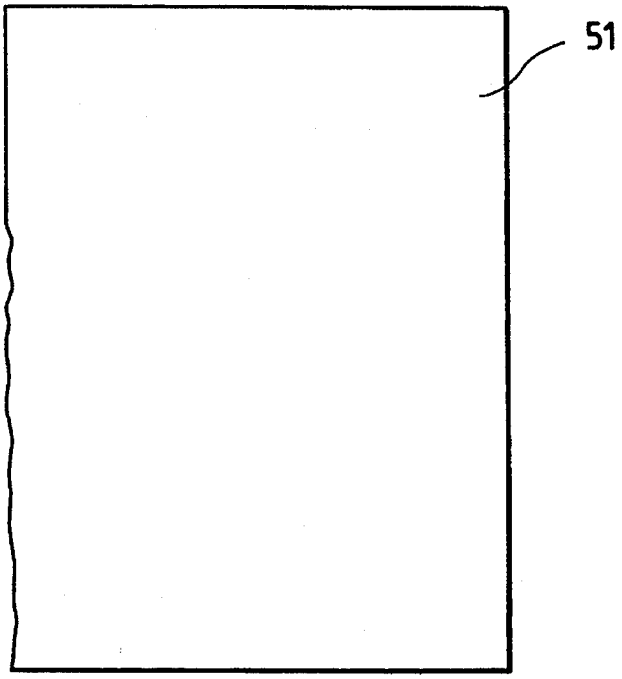
FIG. 12 PRIOR ART
FIG. 12 is a plan view of a recording sheet a lateral edge of which was damaged by the conventional sheet feeding apparatuses.

FIG. 8 is a plan view of a sheet feeding apparatus according to a third embodiment of the present invention. Incidentally, in this embodiment, the same constructural elements as those in the above second embodiment are designated by the same reference numerals, and the detailed explanation thereof will be omitted.

An elongated slot 110 extending to a sheet feeding direction a is formed in a frame 101 in such a manner that it is positioned above a guide 103 by a predetermined distance. A spring 111 is attached to the frame at a predetermined distance from the slot 110. By fitting a shaft 113 on which a cylindrical sheet feed roller (rotary member) 112 is secured into the slot 110, the shaft 113 is rotatably mounted on the frame 101 in such a manner that it is biased toward a reference surface 101*a* by means of the spring 111. Further, the sheet feed roller 112 is biased toward the guide 103 by means of a spring (not shown). The biasing of the sheet feed roller may be effected in the same manner as that shown in FIG. 6. Stoppers 114, 115 for regulating an inclined angle of the shaft 113 are disposed along the elongated slot 110. The stopper 114 is disposed at a position where the shaft 113 becomes perpendicular to the sheet feeding direction a, and the stopper 115 is disposed at a position where it regulates the maximum angle between the shaft 113 and the sheet feeding direction a.

A gear 108 is secured to the shaft 113. By transmitting a driving force from a drive source (not shown) to the gear 108 via the gear 109 constituting a part of a gear train, the sheet feed roller 112 is rotated in a direction shown by the arrow b. Further, in the condition that the gear 108 and the sheet feed roller 112 are secured to the shaft 113, when a distance between a center of the frame 101 (around which the shaft is rocked) and the gear 108 is L1 and a distance between the center of the frame and the sheet feed roller 112 is L2, it is so selected that the distance L2 is sufficiently longer than the distance L1.

With this arrangement, when the sheet 102 is not supplied, the sheet feed roller 112 is biased by the spring to be inclined as shown by the solid line in FIG. 8. When the sheet 102 is supplied in such a manner that the lateral edge of the sheet is spaced apart from the reference surface 101*a* by a distance l, the sheet 102 is subjected to a feeding force directing toward the sheet feeding direction a and a feeding force directing toward the reference surface 101*a*, and is shifted toward the sheet feeding direction a and toward the reference surface 101*a* in opposition to a friction force (f3) between the sheet 102 and the guide 103. As shown by a dot and chain line in FIG. 8, when the sheet 102 is abutted against the reference surface 101*a*, the sheet 102 is subjected to the compression force (f1) between the reference surface 101*a* and the sheet feed roller 112. The spring force (f2) of the spring 111 is so selected that it counterbalances the force that the gear 108 receives from the gear 109, and a relation f1>f2>f3 is established when sheet 102 is at the position shown by the dot and chain line in FIG. 8.

When the sheet 102 is subjected to the compression force (f1) by abutting it against the reference surface 101*a*, the spring 111 is flexed to vary the inclination angle of the shaft 113, with the result that the sheet feed roller 112 is shifted from the solid line position to the broken line position. In response to such shifting of the sheet feed roller 112, the feeding force acting on the sheet 102 and directing toward the reference surface 101*a* becomes weaker accordingly, and, the sheet feed roller 112 is shifted until the compression force f1 acting on the sheet 102 by the sheet feed roller 112 is balanced with the spring force f2, and then, the sheet feed roller is held at that position.

In this case, although the meshing length between the gears 108, 109 is varied, such variation has a value corresponding to the product of the shifting amount of the sheet feed roller 112 and L1/L2, which value is in the order of the value of the module of the gear 108. Therefore, the strength of the gears 108, 109 and the flexural rigidity of teeth of the gears are selected in consideration of the variation in the meshing length between the gears. Thus, even when the sheet 102 to be fed is long, it is possible to abut the sheet 102 against the reference surface 101*a* always with a substantially constant force.

In the illustrated embodiments, while an example that the skew-feed rollers are used as one of the rollers which pinch the sheet therebetween and feed the sheet in order to urge the sheet against the reference guide was explained, the present invention is not limited to this example, but both of the rollers may comprise skew-feed rollers. Further, a member which cooperates with the skew-feed rollers to pinch the sheet therebetween is not limited to the rotary member such as the sheet feed roller, but may be constituted by a guide member having a smooth surface.

What is claimed is:

1. A sheet feeding apparatus, comprising:

regulating means disposed along a sheet feeding path for regulating a position of a lateral edge of a sheet;

first rotary means and second rotary means for feeding the sheet along said sheet feeding path, said first rotary means applying a force to the sheet to urge the sheet lateral edge against said regulating means; and support means for supporting said first rotary means and second rotary means;

wherein one of said first rotary means and said second rotary means shifts away from said regulating means when the sheet is in contact with said first rotary means, said second rotary means, and said regulating means while maintaining constant an angle between a rotational axis of the one of said first rotary means and said second rotary means, and said regulating means.

2. A sheet feeding apparatus according to claim 1, wherein said regulating means has a guide member against which the lateral edge of the sheet can be abutted.

3. A sheet feeding apparatus according to claim 1, wherein said first rotary means is rotated by contact with the sheet.

4. A sheet feeding apparatus according to claim 3, wherein said second rotary means is disposed so that a rotational axis of said second rotary means is inclined with respect to a direction perpendicular to said sheet feeding direction, by a predetermined angle.

5. A sheet feeding apparatus according to claim 1, wherein said first rotary means has a diameter gradually decreasing toward said regulating means.

6. A sheet feeding apparatus according to claim 1, wherein said first rotary means is provided at an outer peripheral surface thereof with a spiral groove.

7. A sheet feeding apparatus according to claim 1, wherein said support means supports said first rotary means for a shifting movement in a direction that said first rotary means is shifted away from said regulating means.

8. A sheet feeding apparatus according to claim 1, wherein said first rotary means and second rotary means pinch the sheet therebetween, and wherein said support means rotatably supports at least one of said first rotary means and second rotary means.

9. A sheet feeding apparatus according to claim 1, wherein said support means includes shaft for supporting said one of the first rotary means and second rotary means.

10. A sheet feeding apparatus according to claim 9, wherein one of said first rotary means and second rotary means is slidably supported on said shaft for movement in an axial direction of said shaft.

11. A sheet feeding apparatus according to claim 10, wherein said support means includes biasing means for biasing one of said first rotary means and second rotary means toward said regulating means.

12. A sheet feeding apparatus according to claim 11, wherein said biasing means has a spring member.

13. A sheet feeding apparatus according to claim 1, wherein said first rotary means includes a first rotary member, and said second rotary means includes a second rotary member.

14. An image forming system, comprising:

regulating means disposed along a sheet feeding path for regulating a position of a lateral edge of a sheet;

first rotary means and second rotary means for feeding the sheet along said sheet feeding path, said first rotary means applying a force to the sheet to urge the sheet lateral edge against said regulating means;

support means for supporting said first rotary means and said second rotary means;

wherein one of said first rotary means and said second rotary means shifts away from said regulating means when the sheet is in contact with said first rotary means, said second rotary means, and said regulating means while maintaining constant an angle between a rotational axis of the one of said first rotary means and said second rotary means, and said regulating means; and image forming means for forming an image on the sheet fed by said sheet feeding means.

15. A sheet feeding apparatus, comprising:

regulating means disposed along a sheet feeding path for regulating a position of a lateral edge of a sheet;

rotary means for feeding the sheet along said sheet feeding path, and for applying a force to the sheet to urge the sheet lateral edge against said regulating means; and support means for supporting said rotary means;

wherein said rotary means shifts away from said regulating means when the sheet is in contact with said rotary means and said regulating means so that a pressing force of the sheet to said regulating means does not become too large, while maintaining constant an angle between a rotational axis of said rotary means and said regulating means.

16. A sheet feeding apparatus according to claim 15, wherein said regulating means has a guide member against which the lateral edge of the sheet can be abutted.

17. A sheet feeding apparatus according to claim 15, wherein a rotational axis of said rotary means is inclined by a predetermined angle with respect to a direction perpendicular to said sheet feeding direction.

18. A sheet feeding apparatus according to claim 15, wherein said rotary means has a diameter gradually decreasing toward said regulating means.

19. A sheet feeding apparatus according to claim 15, wherein said rotary means is provided at an outer peripheral surface thereof with a spiral groove.

20. A sheet feeding apparatus according to claim 15, wherein said support means includes a shaft for supporting said rotary means.

21. A sheet feeding apparatus according to claim 20, wherein said rotary means is slidably supported on said shaft for movement in an axial direction of said shaft.

22. A sheet feeding apparatus according to claim 15, wherein said support means includes biasing means for biasing said rotary means toward said regulating means.

23. A sheet feeding apparatus according to claim 22, wherein said biasing means includes a spring member.

24. A sheet feeding apparatus according to claim 15, wherein said rotary means includes a rotary member.

25. An image forming apparatus, comprising:

regulating means disposed along a sheet feeding path for regulating a position of a lateral edge of a sheet;

rotary means for feeding the sheet along said sheet feeding path, and for applying a force to the sheet to urge the sheet lateral edge against said regulating means;

support means for supporting said rotary means;

wherein said rotary means shifts away from said regulating means when the sheet is in contact with said rotary means and said regulating means so that a pressing force of the sheet to said regulating means does not become too large, while maintaining constant an angle between a rotational axis of said rotary means and said regulating means; and image forming means for forming an image on the sheet fed by said rotary means.

26. A sheet feeding apparatus, comprising:

a regulating member disposed along a sheet feeding path for regulating a position of a lateral edge of the sheet; and a rotary member for feeding the sheet along the sheet feeding path, and applying a force to the sheet in a direction to press it onto said regulating member;

wherein said rotary member shifts away from said regulating member while keeping constant angular alignment when the sheet is in contact with said rotary member and said regulating member.

27. A sheet feeding apparatus according to claim 26, wherein said regulating member comprises a member abutting against the sheet lateral edge.

28. A sheet feeding apparatus according to claim 26, wherein said rotary member comprises a feeding roller which is rotated by a receiving drive force.

29. A sheet feeding apparatus according to claim 26, further comprising a second rotary member cooperating with said rotary member for nipping the sheet.

30. A sheet feeding apparatus according to claim 29, wherein a rotational axis of said second rotary member makes a predetermined angle relative to a direction orthogonal to the sheet feeding direction.

31. A sheet feeding apparatus according to claim 26, wherein a diameter of said rotary member is smaller proximate said regulating member.

32. A sheet feeding apparatus according to claim 26, further comprising a shaft for supporting said rotary member, said rotary member being supported slidably along said shaft.

33. A sheet feeding apparatus according to claim 32, further comprising urging means for urging said rotary member toward said regulating member.

34. A sheet feeding apparatus according to claim 33, wherein said urging means has a spring.

35. An image forming apparatus, comprising:

a regulating member disposed along a sheet feeding path for regulating a position of a lateral edge of the sheet;

a rotary member for feeding the sheet along the sheet feeding path, and applying a force to the sheet in a direction to press it onto said regulating member; and image forming means for forming an image on the sheet fed by said rotary member;

wherein said rotary member shifts away from said regulating member while keeping constant angular alignment when the sheet is in contact with said rotary member and said regulating member.

* * * * *

UNITED STATES PATENT AND TRADEMARK OFFICE

CERTIFICATE OF CORRECTION

PATENT NO. : 5,507,482

DATED : April 16, 1996

INVENTOR(S) : CHITOSE TENPAKU, ET AL.

It is certified that error appears in the above-indentified patent and that said Letters Patent is hereby corrected as shown below:

Title page, item [56], REFS, line 10, "Kirkpatrick." should read --Kirkpatrick--; and line 16, "262562" should read --2626562--.

Column 1, line 4, "07,824,186" should read --07/824,186--; and line 22, "tile" should read --the--.

Column 2, line 44, "reduce," should read --reduced,--.

Column 3, line 46, "23adisposed-- should read --23a disposed--.

Column 4, line 21, "Latent" should read --latent--;

line 33, "dream" should read --drum--; and line 48, "image" should read --images--.

Column 5, line 5, "edges" should read --edge--;

line 9, "a1" should read --$\Delta$1--;

line 54, "81" should read --θ1--; and line 55, "degree," should read --degrees,--.

Column 8, line 67, "102," should read --102--.

UNITED STATES PATENT AND TRADEMARK OFFICE

CERTIFICATE OF CORRECTION

PATENT NO. : 5,507,482

DATED : April 16, 1996

INVENTOR(S) : CHITOSE TENPAKU, ET AL.

It is certified that error appears in the above-indentified patent and that said Letters Patent is hereby corrected as shown below:

Column 10,
line 12, "f1>f2>f3" should read --f1>f2≥f3--.

Column 11,
line 23, "includes" should read --includes a--.

Signed and Sealed this

Twenty-fourth Day of December, 1996

*Attest:*

Bruce Lehman

BRUCE LEHMAN

*Attesting Officer*

*Commissioner of Patents and Trademarks*